US008102325B2

(12) United States Patent
Feller et al.

(10) Patent No.: US 8,102,325 B2
(45) Date of Patent: Jan. 24, 2012

(54) GNSS ANTENNA WITH SELECTABLE GAIN PATTERN, METHOD OF RECEIVING GNSS SIGNALS AND ANTENNA MANUFACTURING METHOD

(75) Inventors: Walter Feller, Airdrie (CA); Xiaoping Wen, Calgary (CA)

(73) Assignee: Hemisphere GPS LLC, Calgary, Alberta (CA)

( * ) Notice: Subject to any disclaimer, the term of this patent is extended or adjusted under 35 U.S.C. 154(b) by 473 days.

(21) Appl. No.: 12/268,241

(22) Filed: Nov. 10, 2008

(65) Prior Publication Data

US 2010/0117914 A1 May 13, 2010

(51) Int. Cl.
*H01Q 9/28* (2006.01)

(52) U.S. Cl. ..... 343/795; 343/797; 343/757; 343/766; 343/761

(58) Field of Classification Search ..... 343/757, 343/839, 795, 797, 766, 761
See application file for complete search history.

(56) References Cited

U.S. PATENT DOCUMENTS

| | | | | |
|---|---|---|---|---|
| 5,523,761 | A | 6/1996 | Gildea | |
| 5,574,978 | A * | 11/1996 | Talwar et al. | 455/63.1 |
| 6,335,703 | B1 * | 1/2002 | Chang et al. | 343/700 MS |
| 6,414,638 | B1 | 7/2002 | Egashira | |
| 6,516,271 | B2 | 2/2003 | Upadhyaya et al. | |
| 6,535,179 | B1 * | 3/2003 | Petros | 343/895 |
| 6,549,835 | B2 | 4/2003 | Deguchi | |
| 6,774,843 | B2 | 8/2004 | Takahashi | |
| 6,822,314 | B2 | 11/2004 | Beasom | |
| 7,006,032 | B2 | 2/2006 | King et al. | |
| 7,089,099 | B2 | 8/2006 | Shostak et al. | |
| 7,224,246 | B2 | 5/2007 | Thomas | |
| 7,271,766 | B2 | 9/2007 | Zimmerman et al. | |
| 2005/0116869 | A1 * | 6/2005 | Siegler et al. | 343/749 |
| 2005/0174297 | A1 | 8/2005 | Cake | |
| 2006/0189288 | A1 * | 8/2006 | Jin et al. | 455/232.1 |
| 2006/0273865 | A1 * | 12/2006 | Timofeev et al. | 333/161 |
| 2007/0146206 | A1 * | 6/2007 | Sun | 343/700 MS |
| 2007/0285308 | A1 | 12/2007 | Bauregger et al. | |
| 2008/0220738 | A1 * | 9/2008 | Takikawa et al. | 455/333 |
| 2009/0096700 | A1 * | 4/2009 | Chair | 343/797 |
| 2009/0273522 | A1 * | 11/2009 | Tatarnikov et al. | 343/700 MS |
| 2010/0013730 | A1 * | 1/2010 | Azhari | 343/848 |
| 2010/0117914 | A1 | 5/2010 | Feller et al. | |

OTHER PUBLICATIONS

Yang, F. et al., "A single layer dual band circularly polorized micropstrip antenna for GPS application", *IEEE Antenna and Propagation Society International Symposium*, vol. 4. pp. 720-723, Jun. 2002, 720-723. Padhi, K. et al., "An EM-coupled dual-polarized microstrip patch antenna for RFID applications", *Microwave and optical technology letter*, vol. 39., No. 5, pp. 345-360, 2003, 345-360. Richter, Paul H., et al., "Improved Blind Pointing of NASA's Beam-Waveguide Antennas for Millimeter Wave Operation", *Jet Propulsion Lab Technical Report Series 1992*. Published Apr. 4, 2000. "International Search Report", PCT/US09/33567, (Feb. 9, 2009). "International Search Report / Written Opinion", PCT/US09/63594, (Jan. 11, 2010).

* cited by examiner

*Primary Examiner* — Jacob Y Choi
*Assistant Examiner* — Shawn Buchanan
(74) *Attorney, Agent, or Firm* — Law Office of Mark Brown LLC; Mark E. Brown

(57) ABSTRACT

An antenna is provided for GNSS and other applications and includes an adjustable-height vertical support PCB mounted on a ground plane and mounting a crossed-dipole radiating arm element assembly. The gain pattern of the antenna can be varied by constructing the vertical support PCB with different heights or adjusting the height and gain pattern in the field. Vehicles with significant pitch and roll can be provided with low-horizon tracking capability by providing a high-profile antenna configuration. Alternatively, low-profile configurations provide steeper gain pattern rolloff at the horizon for maximal multipath rejection and high accuracy. The droop angles of the radiating arm elements are also adjustable for varying the gain pattern and beamwidth. A matching and phasing network is connected to the radiating arm elements and provides a relatively constant input impedance for the various antenna configurations. Alternative aspects of the invention have different configurations of the radiating arm elements and ground planes.

18 Claims, 15 Drawing Sheets

Beam Pattern Vert Plane

Beam Pattern Vert Plane

GNSS ANTENNA WITH SELECTABLE GAIN PATTERN, METHOD OF RECEIVING GNSS SIGNALS AND ANTENNA MANUFACTURING METHOD

BACKGROUND OF THE INVENTION

1. Field of the Invention

The present invention relates generally to antennas, and in particular to a broadband, crossed-dipole antenna with selectable gain patterns, which is particularly well-suited for GNSS applications.

2. Description of the Related Art

Various antenna designs and configurations have been produced for transmitting and receiving electromagnetic (wireless) signals. Antenna design criteria include the signal characteristics and the applications of the associated equipment, i.e. transmitters and receivers. For example, stationary, fixed applications involve different antenna design configurations than mobile equipment.

Global navigation satellite systems (GNSS) have progressed within the last few decades to their present state-of-the-art, which accommodates a wide range of positioning, navigating and informational functions and activities. GNSS applications are found in many industries and fields of activity. For example, navigational and guidance applications involve portable GNSS receivers ranging from relatively simple, consumer-oriented, handheld units to highly sophisticated airborne and marine vessel equipment.

Vehicle-mounted antennas are designed to accommodate vehicle motion, which can include movement in six degrees of freedom, i.e. pitch, roll and yaw corresponding to vehicle rotation about X, Y and Z axes in positive and negative directions respectively. Moreover, variable and dynamic vehicle attitudes and orientations necessitate antenna gain patterns which provide GNSS ranging signal strengths throughout three-dimensional ranges of motion corresponding to the vehicles' operating environments. For example, aircraft in banking maneuvers that the require below-horizon signal reception. Ships and other large marine vessels, on the other hand, tend to operate relatively level and therefore normally do not require below-horizon signal acquisition. Terrestrial vehicles have varying optimum antenna gain patterns dependent upon their operating conditions. Agricultural vehicles and equipment, for example, often require signal reception in various attitudes in order to accommodate operations over uneven terrain. Modern precision agricultural GNSS guidance equipment, e.g., sub-centimeter accuracy, requires highly efficient antennas which are adaptable to a variety of conditions.

Another antenna/receiver design consideration in the GNSS field relates to multipath interference, which is caused by reflected signals that arrive at the antenna out of phase with the direct signal. Multipath interference is most pronounced at low elevation angles, e.g., from about 10° to 20° above the horizon. They are typically reflected from the ground and ground-based objects. Antennas with strong gain patterns at or near the horizon are particularly susceptible to multipath signals, which can significantly interfere with receiver performance based on direct line-of-sight (LOS) reception of satellite ranging signals and differential correction signals (e.g., DGPS). Therefore, important GNSS antenna design objectives include achieving the optimum gain pattern, balancing rejecting multipath signals and receiving desired ranging signals from sources, e.g., satellites and pseudolites, at or near the horizon.

The present invention addresses these objectives by providing GNSS antennas with selectable gain patterns. For example, a wide beamwidth with tracking capability below the horizon is possible with a taller central support mounting a radiating element arm assembly of a crossed-dipole antenna. A wide beamwidth is preferred for vehicles which have significant pitch and roll, such as aircraft and small watercraft. By reducing the height of the central support structure a much steeper roll off at the horizon is generated with attenuated back lobes, which is preferred for maximal multipath rejection in high accuracy applications. Such alternative configurations can be accommodated by changing the height of the support element, which is preferably designed and built for assembly in multiple-height configurations depending upon the particular intended antenna applications.

Another beamwidth-performance variable relates to the deflection or "droop" of the crossed-dipole radiating element arms, which can range from nearly horizontal to a "full droop" position attached at their ends to a ground plane. Wider beamwidths are achieved by increasing the downward deflection whereas multipath rejection is enhanced by decreasing droop. Preferably a selectable gain antenna accommodates such alternative configurations without significantly varying the input impedance whereby common matching and phasing networks can be used for all applications.

Heretofore there has not been available an antenna with the advantages and features of the present invention.

SUMMARY OF THE INVENTION

In the practice of an aspect of the present invention, a crossed-dipole, GNSS antenna with selectable gain patterns is provided. The antenna includes a radiating arm element assembly mounted on an upright PCB support, which is mounted on a ground base. The ground base is mounted on a base PCB with a low noise amplifier (LNA). Antenna gain patterns are selectable for particular applications and operating conditions by varying the radiating arm element configurations, varying the PCB support height and reconfiguring the effective ground base.

DETAILED DESCRIPTION OF THE PREFERRED EMBODIMENTS

I. Introduction and Environment

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, up, down, front, back, right and left refer to the invention as oriented in the view being referred to. The words "inwardly" and "outwardly" refer to directions toward and away from, respectively, the geometric center of the embodiment being described and designated parts thereof. Said terminology will include the words specifically mentioned, derivatives thereof and words of similar meaning. Global navigation satellite systems (GNSS) are broadly defined to include GPS (U.S.), Galileo (proposed), GLONASS (Russia), Beidou (China), Compass (proposed), IRNSS (India, proposed), QZSS (Japan, proposed) and other current and future positioning technology using signals from satellites, with or without augmentation from terrestrial sources. Yaw, pitch and roll refer to moving component rotation about the Z, X and Y axes respectively. Said terminology will include the words specifically mentioned, derivatives thereof and words of similar meaning.

Without limitation on the generality of useful applications of the antennas of the present invention, GNSS represents an exemplary application, which utilizes certain advantages and features.

II. Selectable-Gain GNSS Antenna 2

Figure 1A:
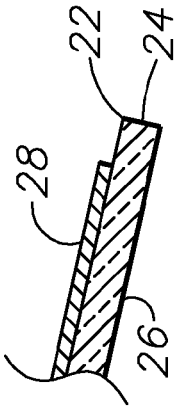
FIG. 1A is an enlarged, fragmentary, crossed-sectional view of an antenna arm element, particularly showing the conducting and PCB layers.
Figure 1:
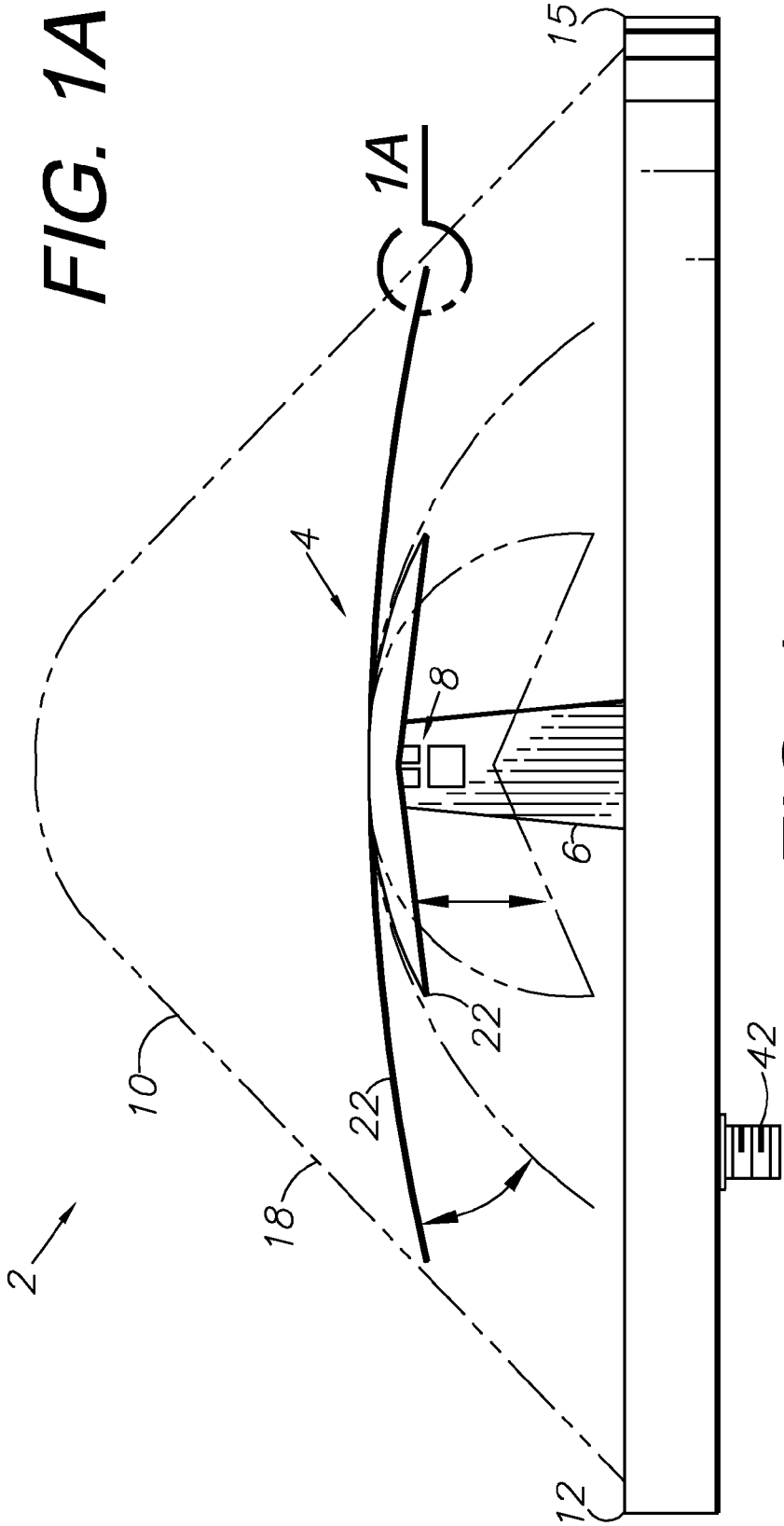
FIG. 1 is a side elevational view of a crossed-dipole GNSS antenna with selectable gain pattern embodying an aspect of the present invention.

Referring to FIG. 1 of the drawings in more detail, the reference numeral 2 generally designates a GNSS antenna embodying an aspect of the present invention. The antenna 2 generally comprises a crossed-dipole configuration with a radiating arm element assembly 4 mounted on an adjustable-height PCB vertical support 6, which includes a matching network circuit 8. An enclosure 10 includes an enclosure base 12, which receives a base printed circuit board (PCB) 14 including a low noise amplifier (LNA) 16, and a radome cover 18. The enclosure base 12 and the base PCB 14 collectively comprise an antenna base 15.

The crossed-dipole radiating arm element assembly 4 includes a central hub 20 and four arms 22 extending generally outwardly therefrom in radially-spaced relation at ninety degree intervals with respect to each other. The arms 22 have generally triangular configurations with notched ends 24 and comprise flexible PCBs 26 with suitable conducting layers 28 (FIG. 1A), all of which can be configured as necessary for optimizing performance. The notched triangular shapes of the arms 22 facilitate operation over a relatively wide range of frequencies with good radiation efficiency. Therefore, the antenna 2 can operate across both "super bands" of GNSS frequencies, i.e. L1 spanning 1525-1613 MHz and L2 spanning 1165-1253 MHz. The antenna 2 is also adaptable of operating in other GNSS frequencies, including both existing systems and others projected for operational status.

Figure 3:
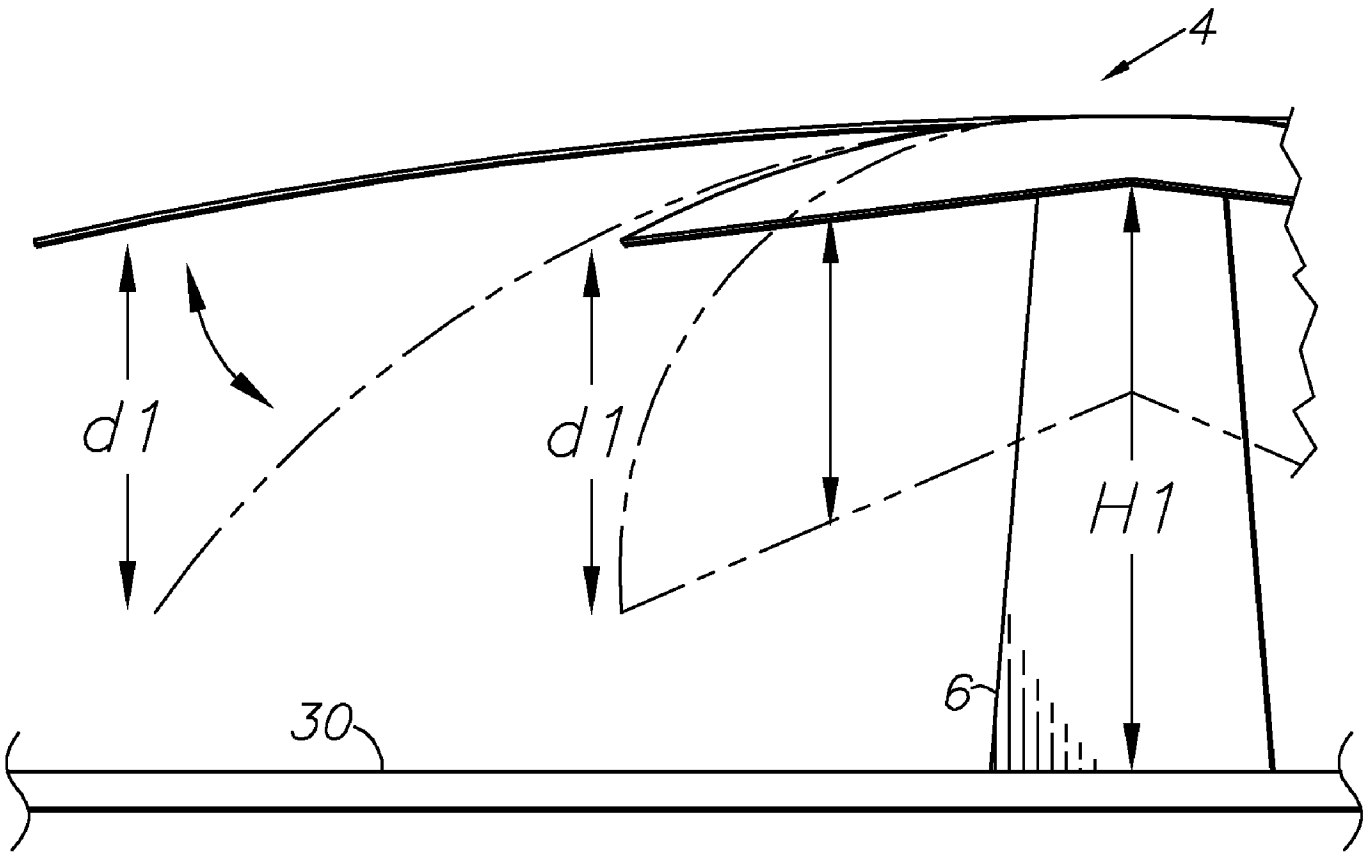
FIG. 3 is a fragmentary, side elevational view thereof particularly showing first and second deflection configurations of a radiating arm element assembly.

The flexibility of the arms 22 enables adjustment of their respective downward deflection or "droop." As shown in FIG. 3, a deflection d1 range is accommodated by flexing the arms 22. Alternatively, the arm ends 24 can be attached to a ground plane 30 for maximum droop configuration.

Figure 2:
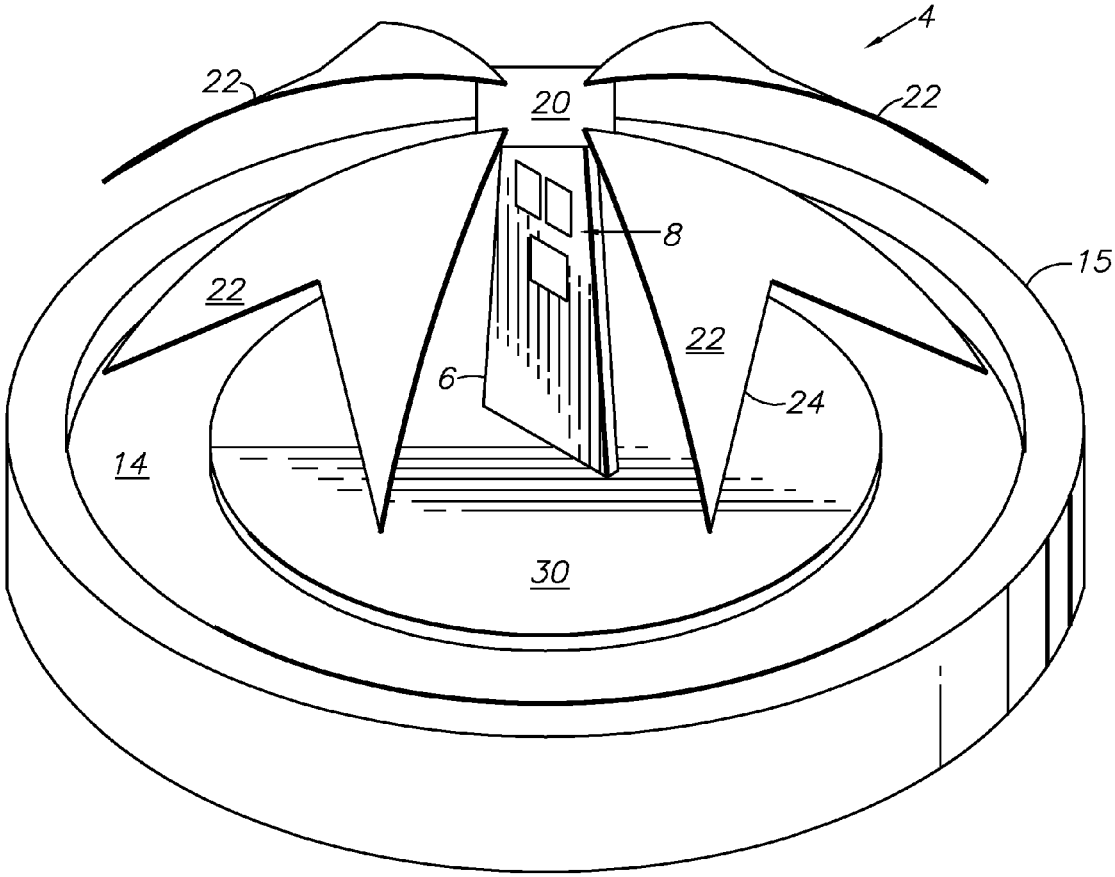
FIG. 2 is an upper perspective view thereof with its radome cover removed.
Figure 6:
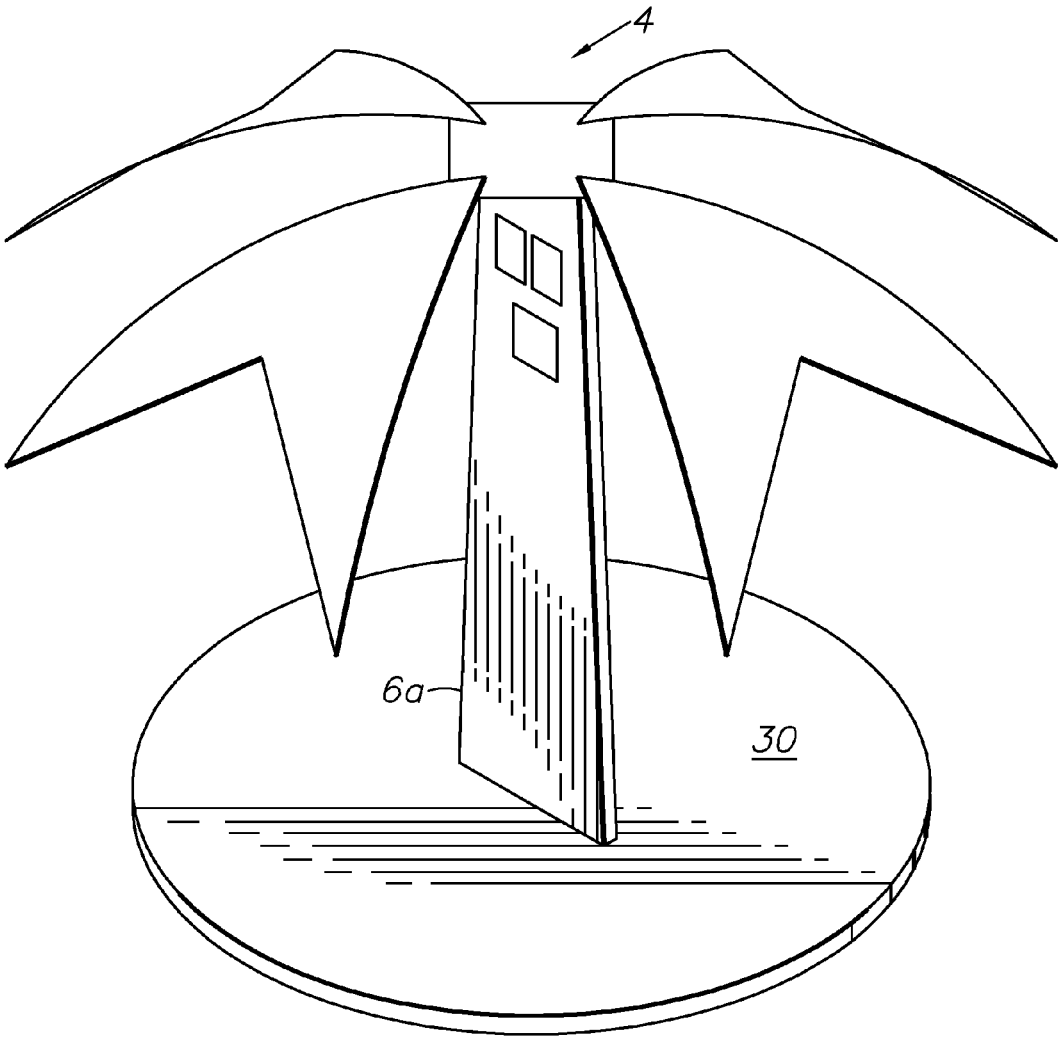
FIG. 6 is a fragmentary, upper perspective view thereof, showing a taller radiating element assembly support.
Figure 7:
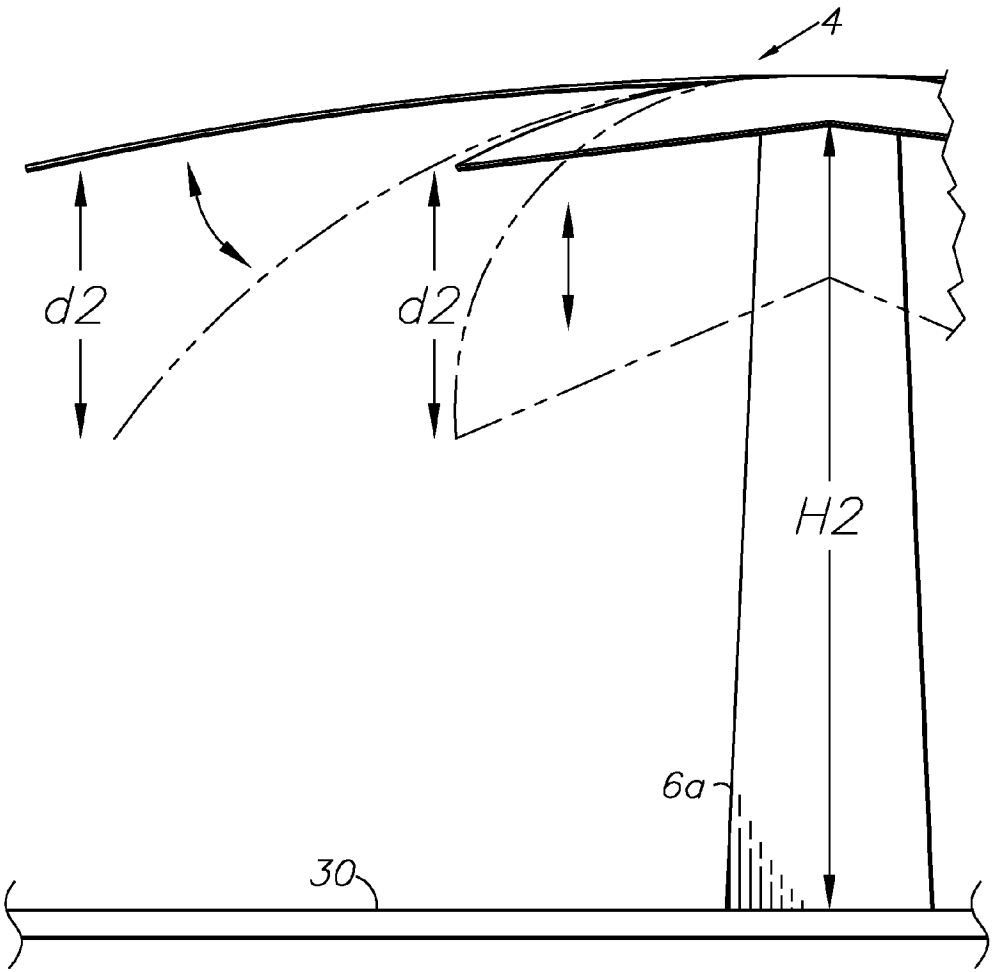
FIG. 7 is a fragmentary, side elevational view thereof particularly showing first and second deflection configurations of a radiating arm element assembly.

The vertical support 6 is configured for mounting on the ground plane 30 at multiple locations corresponding to multiple radiating arm element assembly 4 heights. For example, FIGS. 1-3 show a lower height H1, e.g. approximately 3 cm. FIGS. 6 and 7 show an alternative mounting for a vertical support 6*a* providing a greater height H2, e.g., approximately 6 cm, which is better suited for applications such as aircraft where significant pitch and roll are encountered and below-horizon signal acquisition is important.

Figure 4:
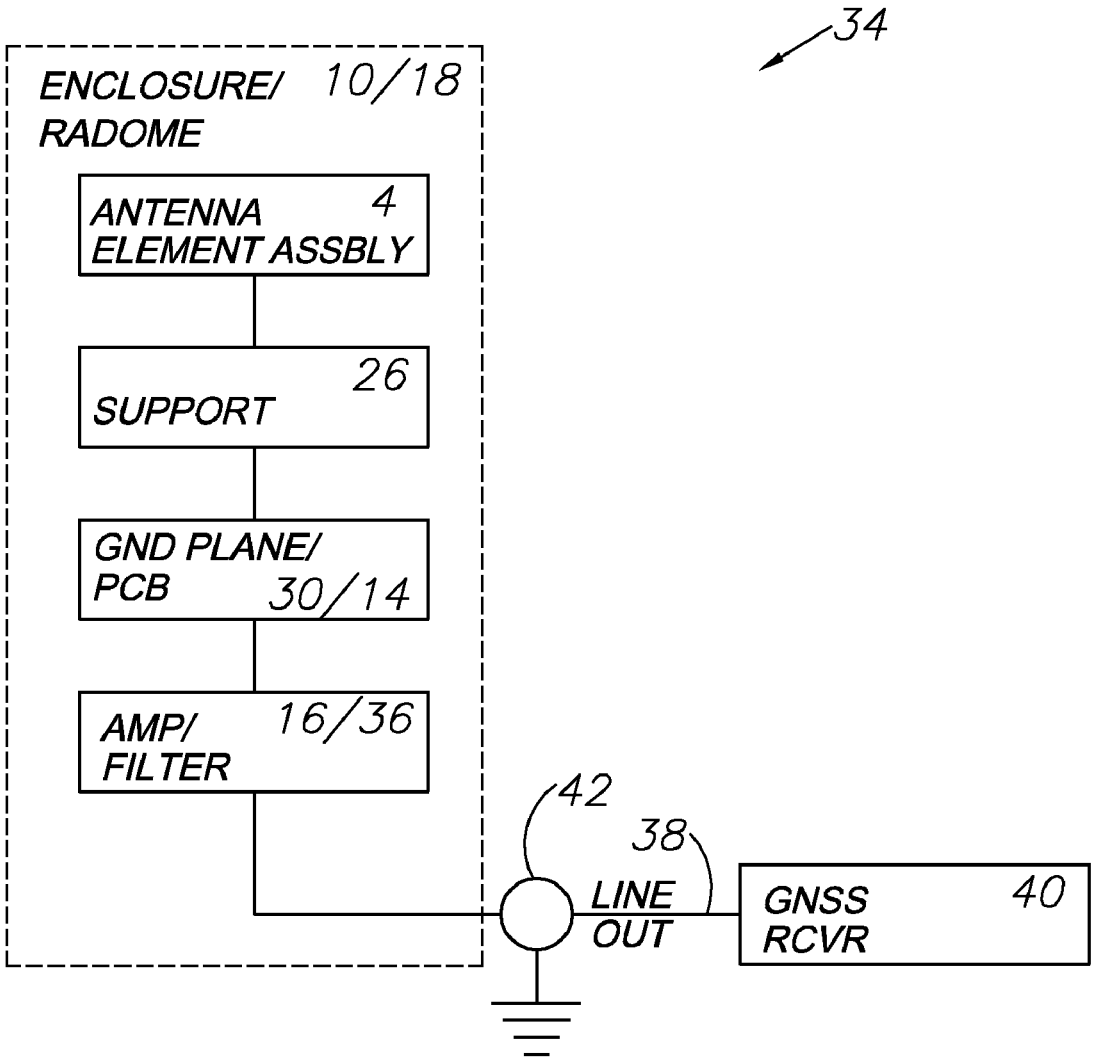
FIG. 4 is a schematic block diagram thereof.
Figure 5:
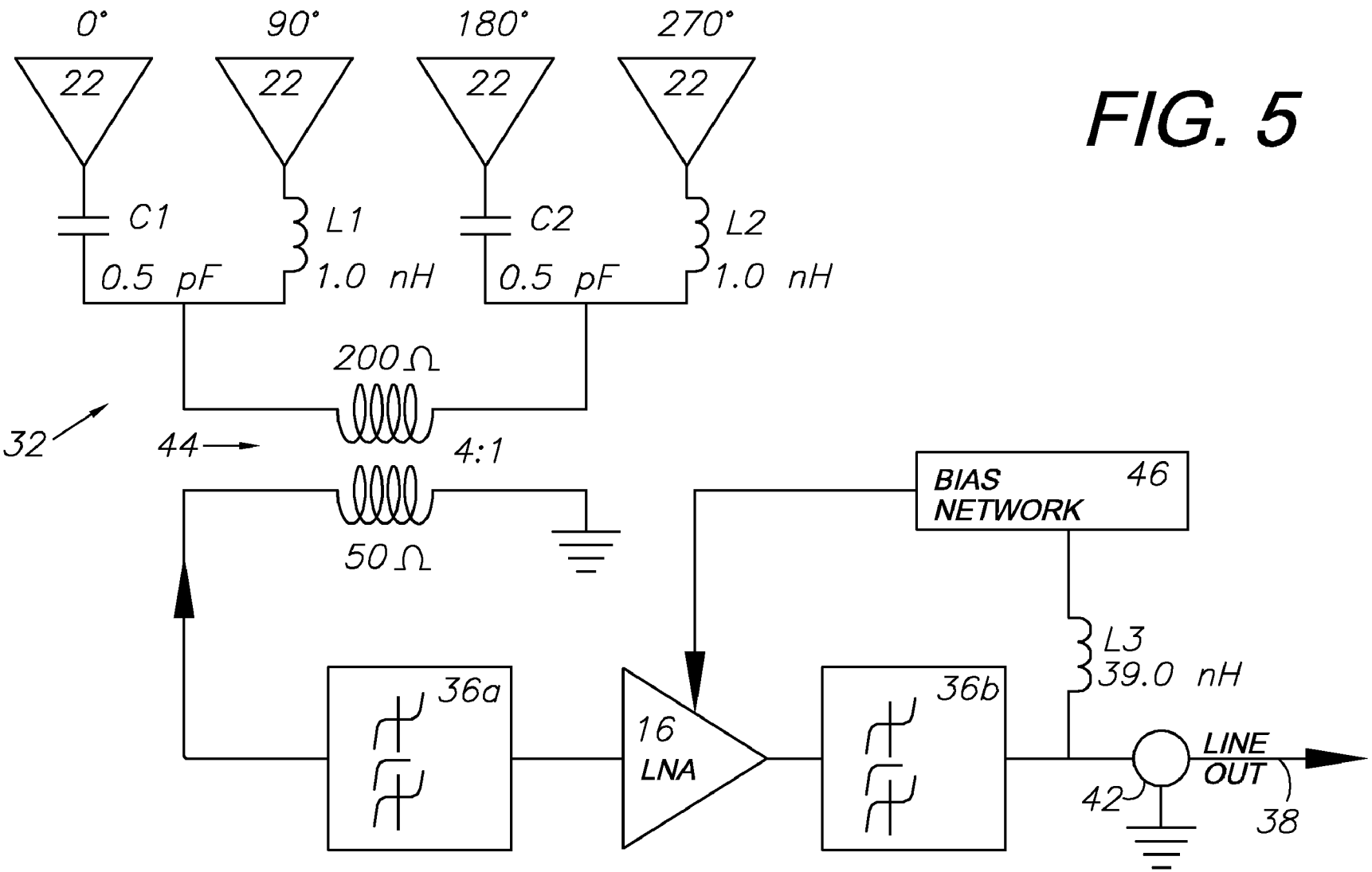
FIG. 5 is a schematic circuit diagram thereof.

FIG. 4 is a schematic block diagram of a GNSS antenna/receiver system 34 comprising an exemplary application or aspect of the present invention. The system 34 includes the antenna 2, the support 6, the base PCB 14 and the ground plane 30. The low noise amplifier 16 and a filter 36 are mounted in the enclosure 10, which includes the radome cover 10. A line out 38, such as a coaxial cable, extends from the LNA 16 and the filter 36 to a GNSS receiver 40 via a grounded connection 42. As shown in FIG. 5, the PCB support 6 mounts a phasing and matching network 32 comprising capacitors C1 and C2 (e.g., 0.5 pF) connected to an opposed pair of arms 22. Inductance can be provided in the other pair of opposed arms 22 by narrow conductor traces providing the equivalent of inductors L1 and L2 (e.g., 1.0 nH). The antenna radiating arm element assembly 4 effectively provides impedance of 200Ω with +j100Ω of reactance with these components. The variable construction of the antenna 2 maintains a relatively constant input impedance through various configurations of center support 6 height and arm 22 deflection. This feature permits the use of a common matching and phasing network for all applications. Moreover, the same LNA 16 can be used for both design heights provided the LNA 16 of the low-profile unit is housed with an extended metal ground plane 30. For example, an 18 cm diameter ground plane can be used for the low-profile antenna and a 15 cm diameter ground plane can be used for the high-profile antenna.

A 4:1 balun transformer 44 and the capacitors C1 and C2 provide a matching network. Collectively, the components of the phasing and matching network 32 provide a 45° lead to the capacitance arms 22 and a 45° lag to the inductive arms 22, thus creating a rotating vector with right hand circular polarization. The filter 36 comprises a pair of bandpass filters 36*a*, 36*b* connected to inputs and outputs respectively of the LNA 16. A bias network 46 is provided in a feedback loop with an inductor L3.

III. Construction and Operation

Figure 8:
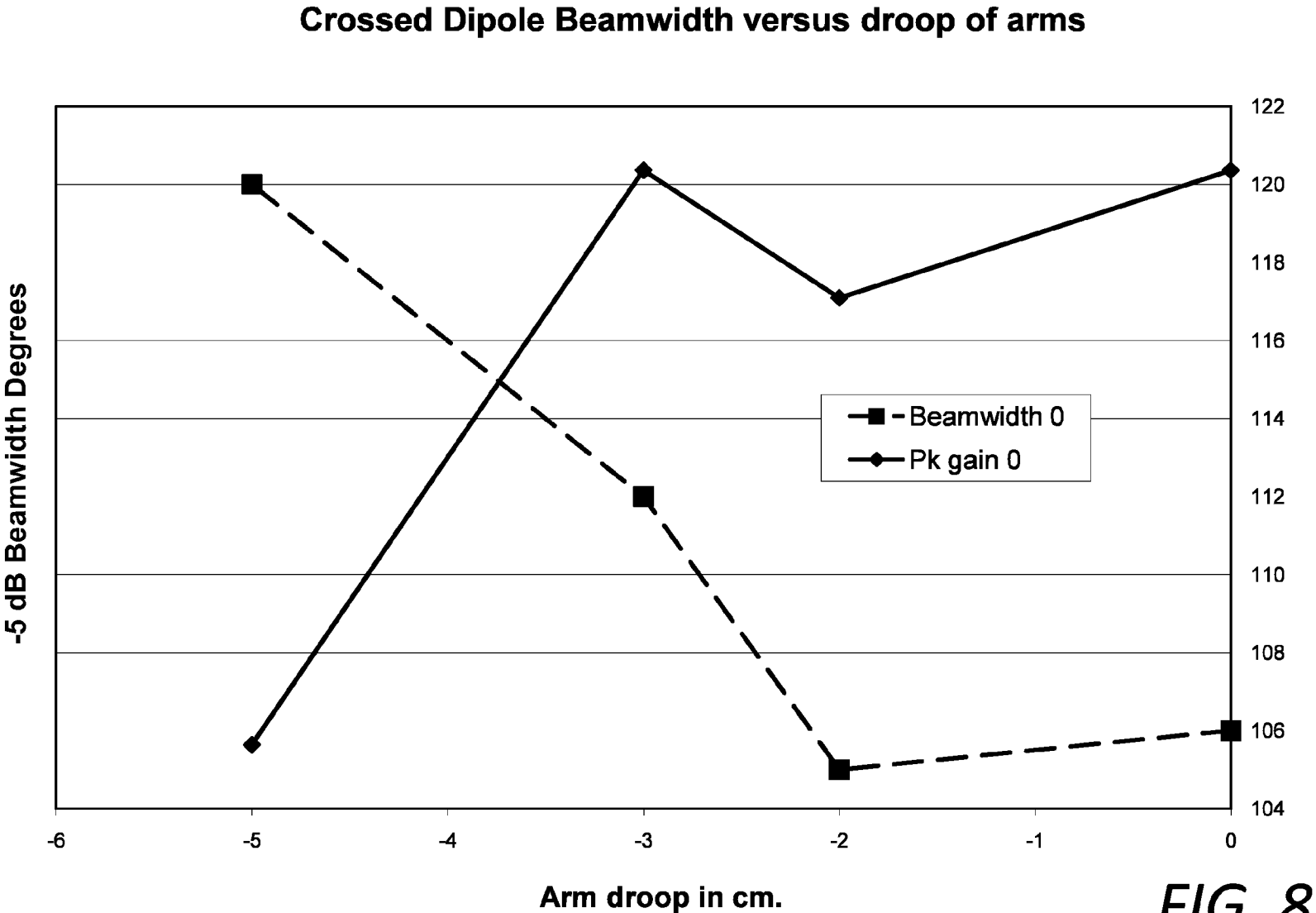
FIG. 8 is a graph showing beamwidth versus height for the crossed-dipole GNSS antenna.
Figure 9:
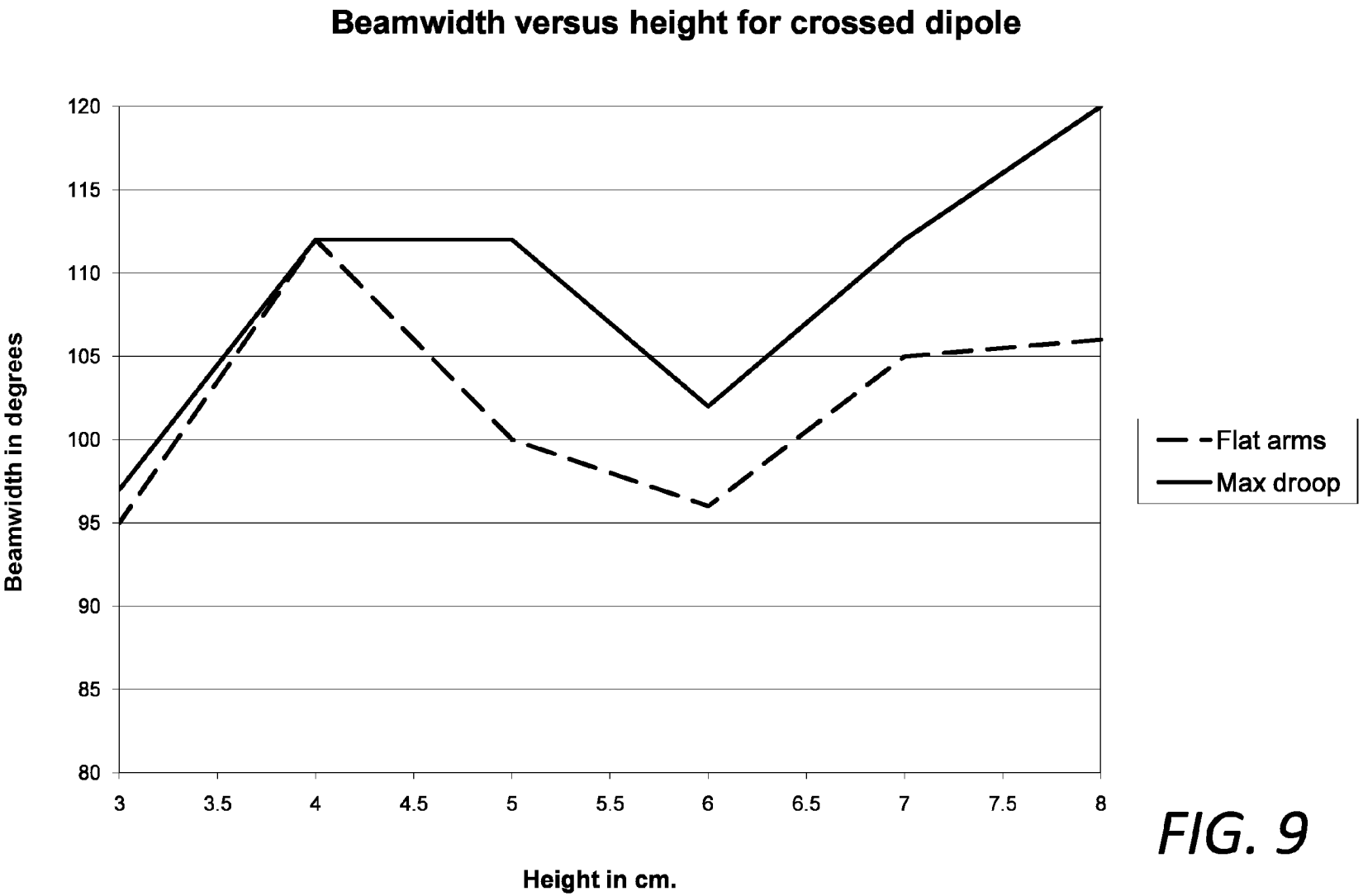
FIG. 9 is a graph showing beamwidth versus antenna element arm droop for the crossed-dipole GNSS antenna.
Figure 10A:
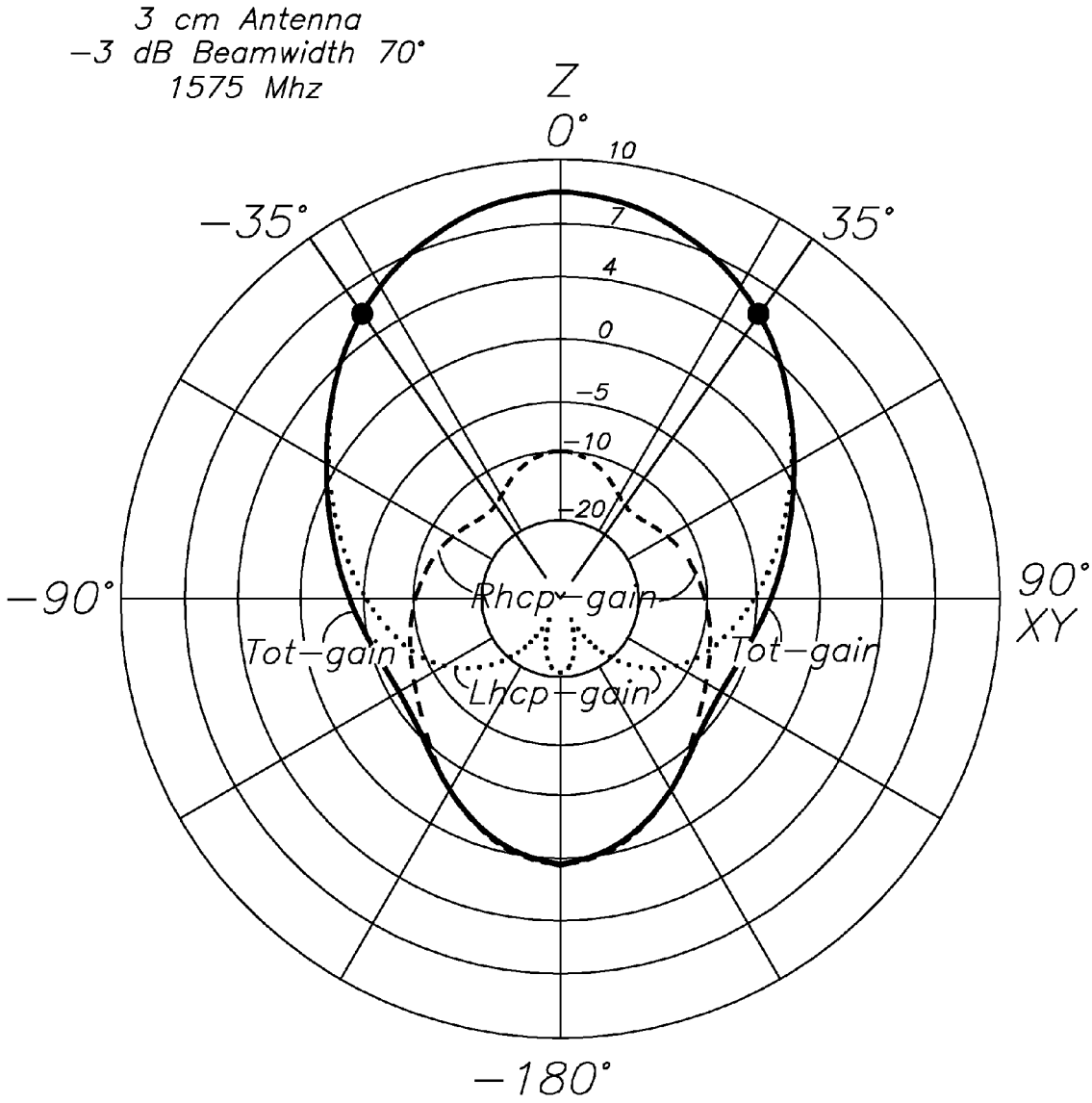
FIG. 10A is a simulated beam pattern for a 3 cm tall antenna with a 70° beamwidth.
Figure 10B:
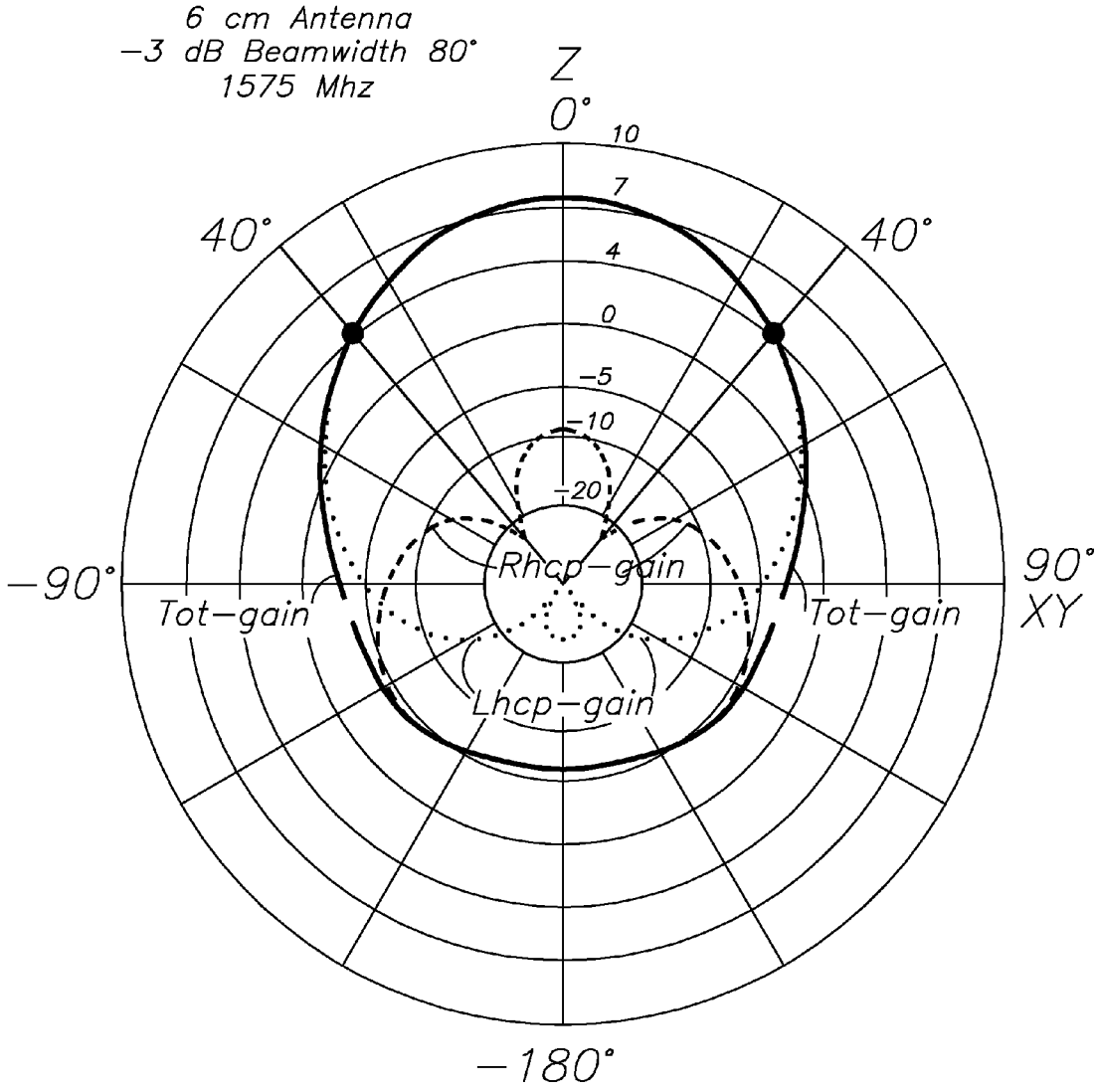
FIG. 10B is a simulated beam pattern for a 6 cm tall antenna with a 90° beamwidth.

In operation, the antenna 2 is adjustably reconfigurable for multiple performance characteristics. For example, adjusting the height of the center support PCB 6 (H1 and H2) alters the ranging signal beamwidth and gain, especially from low elevation satellite sources. Such height adjustment can be accommodated by manufacturing only the taller center support PCB 6*a*, which can be cut at a predetermined location for producing the low-profile antenna 2. Greater manufacturing efficiencies can thus be achieved by minimizing the number of components required for constructing antennas of different configurations. The inductive traces for the pairs of crossarms 22 are adapted for connection to the leads for the phasing and matching network 32 at the upper end of the central support 6 whereby the radiating arm element assembly 4 is attached to the central support 6. FIG. 8 shows beamwidth versus height for the antenna 2, and also illustrates flat arms 22 versus maximum deflection (droop). FIG. 9 shows beamwidth versus angle (droop) of the arms 22. FIG. 10A illustrates the beam pattern (−3 dB, 70°) for the 3 cm tall antenna 2. FIG. 10B shows the beam pattern (90°) for the 6 cm tall antenna 2.

IV. Alternative Aspect Antennas

Figure 11:
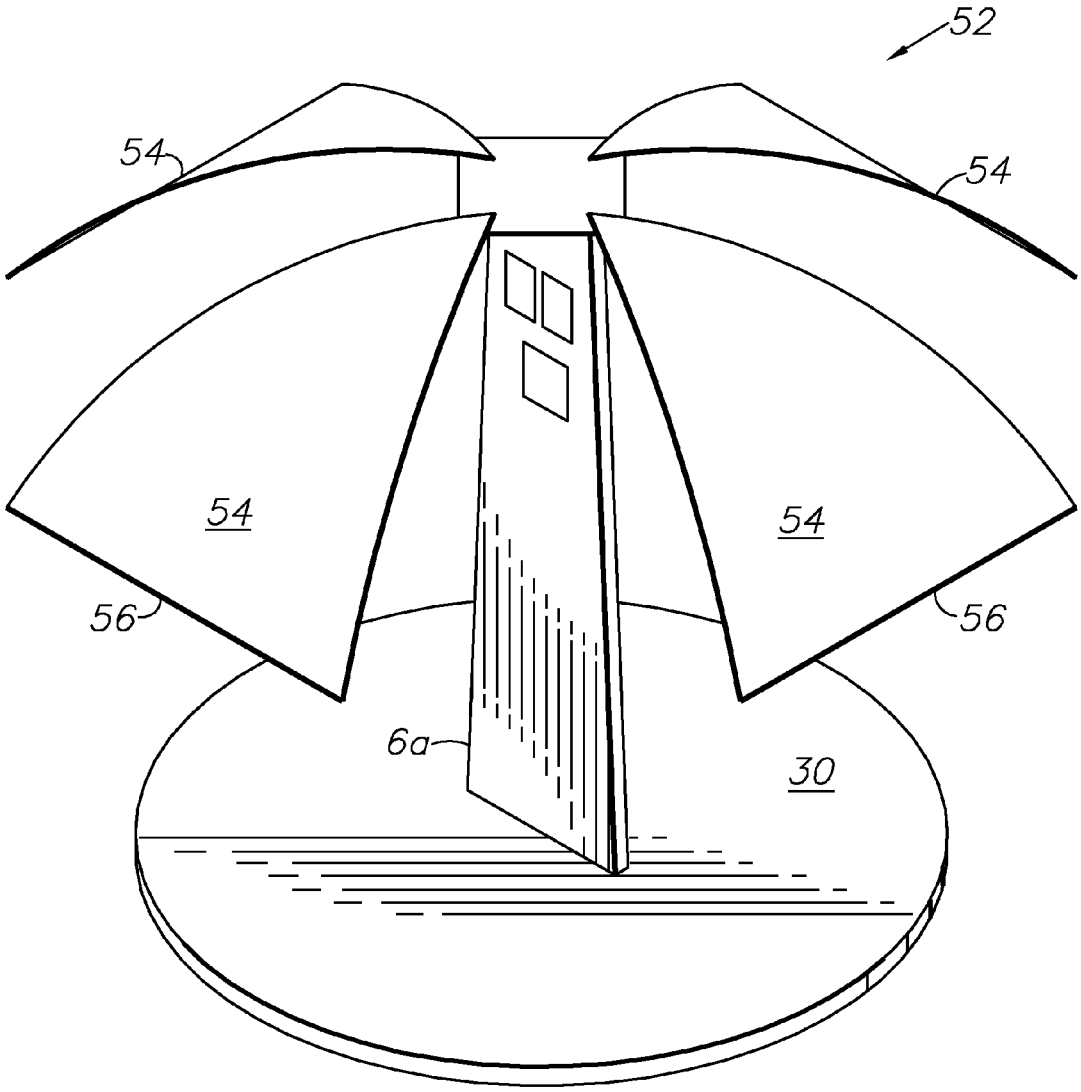
FIG. 11 is a fragmentary, upper perspective view of a crossed-dipole GNSS antenna embodying an alternative aspect of the present invention with modified radiating element arms.
Figure 12:
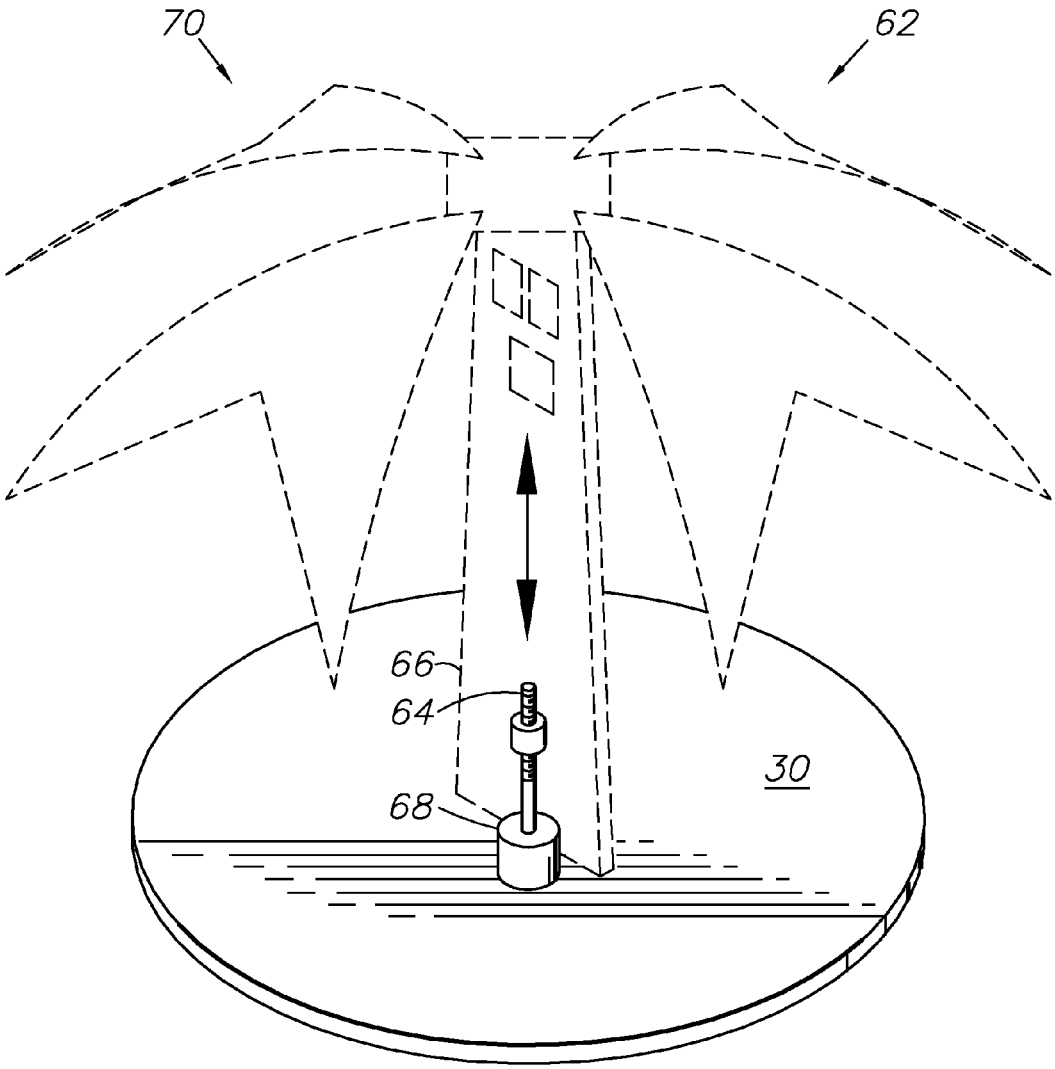
FIG. 12 is a fragmentary, upper perspective view of a crossed-dipole GNSS antenna comprising a first alternative aspect of the present invention with a drive mechanism for raising and lowering a radiating element assembly and support.

FIG. 11 shows an antenna 52 comprising a modified or alternative aspect of the present invention with arm elements 54 having squared off or blunt ends 56. FIG. 12 shows an antenna 62 comprising another alternative aspect or embodiment of the present invention with an adjustable-height center support structure 64 with a threaded rod 66 which can alternatively be driven by a reversible motor 68 or by hand whereby a radiating arm element assembly 70 is height-adjustable. Thus, the operator can perform antenna height adjustments and alter the gain characteristics as desired. Moreover, such adjustments can be automated in order to respond to particular field conditions and combinations of signals received.

Figure 13A:
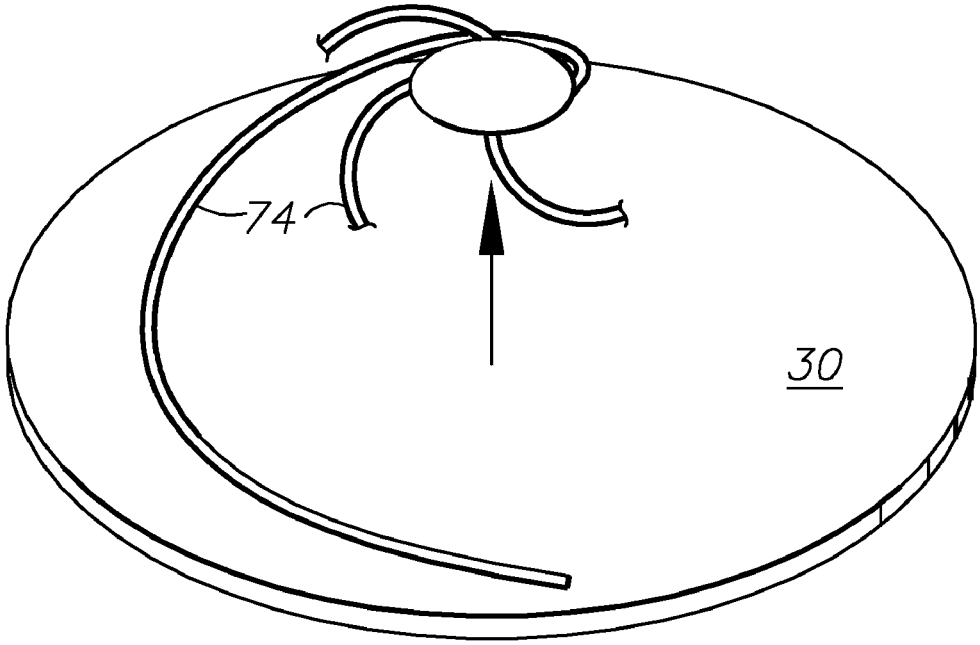
FIG. 13A is a fragmentary, perspective view thereof, particularly showing the radiating arm elements in a raised position.
Figure 13:
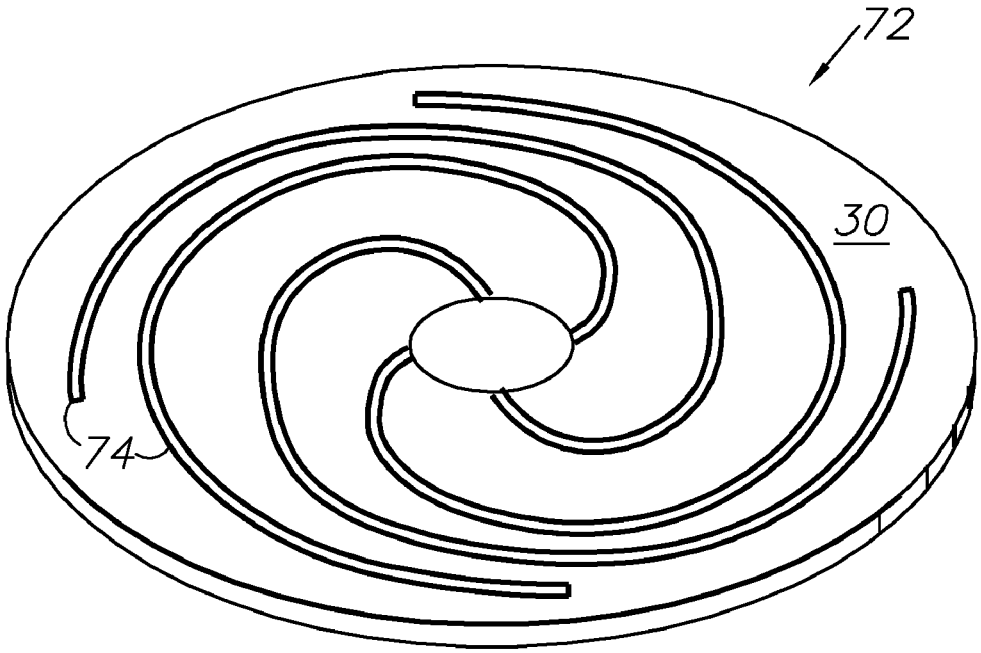
FIG. 13 is a fragmentary, upper perspective view of a GNSS antenna comprising a second alternative aspect of the present invention with a pinwheel radiating arm element configuration.
Figure 14:
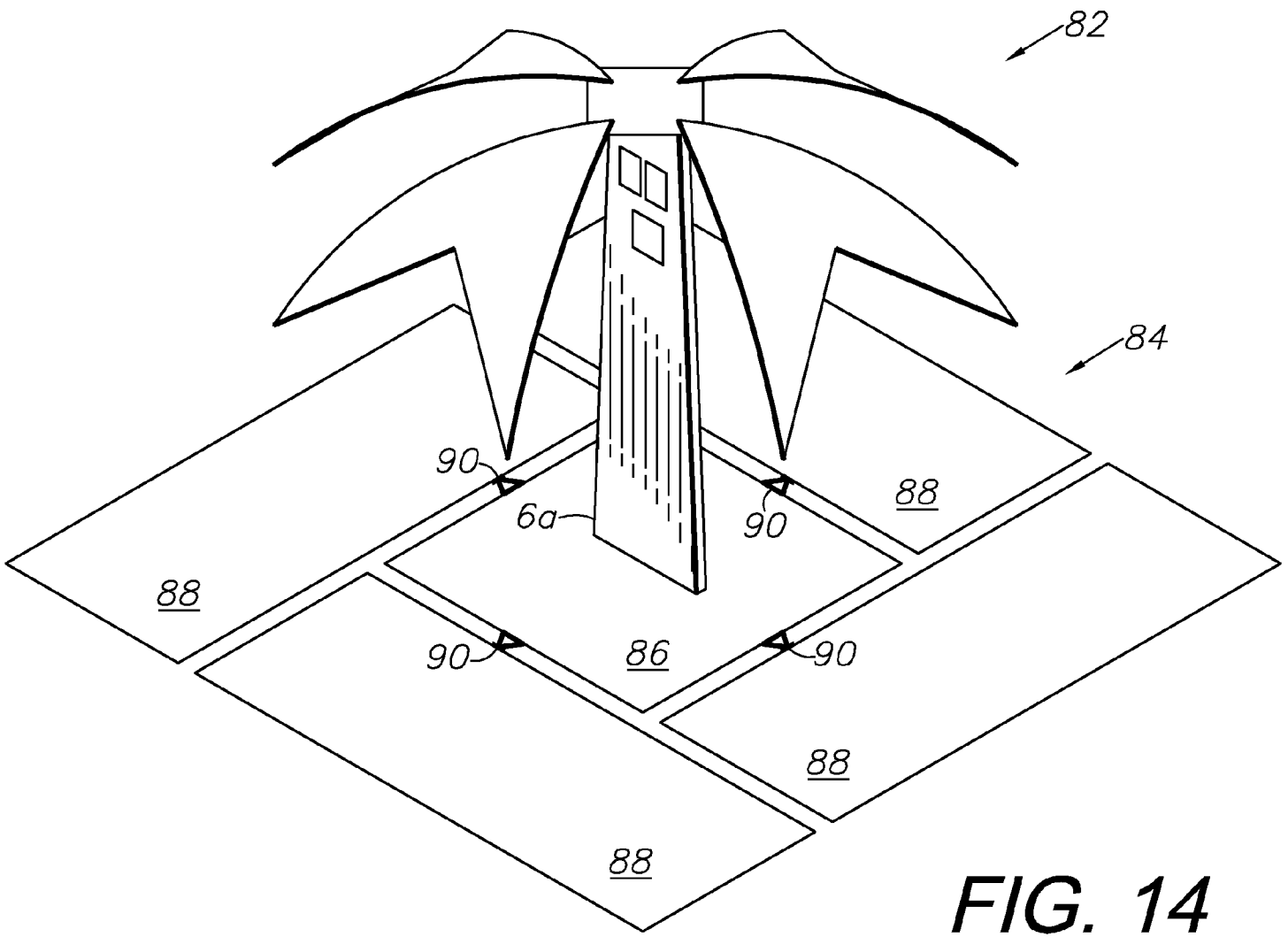
FIG. 14 is a fragmentary, upper perspective view of a GNSS antenna comprising a third alternative aspect of the present invention with a ground plane 4 adapted for effective size adjustment via PiN switching diode connectors.

FIGS. 13 and 13A show an antenna 72 comprising yet another alternative aspect or embodiment of the present invention with spiral or helical radiating element arms 74, which are shown in a lowered position in the FIG. 13 and a raised position in FIG. 13A. The spiral/helical configuration as shown provides a right hand polarization, along with adjustable gain operating characteristics. FIG. 14 shows an antenna 82 with an effectively adjustable ground plane 84 comprising a central ground plane element 86 surrounded by multiple (e.g., four are shown) extension elements 88. Each extension element 88 is connected to the central element 86 by a respective PiN diode 90, which functions as an RF switch. Thus, by applying a forward bias to a PiN diode 90, it effectively operates as a conductor whereby the effective size of the ground plane is increased. Still further, the PiN diodes can be selectively activated to provide further adjustability of the ground plane 84 effective area.

It is to be understood that the invention can be embodied in various forms, and is not to be limited to the examples discussed above. The range of components and configurations which can be utilized in the practice of the present invention is virtually unlimited.

Having thus described the invention, what is claimed as new and desired to be secured by Letters Patent is:

1. A GNSS antenna, which includes:

a base including a conductor ground plane;

a radiating element;

an adjustable support connected to said base and to said element and supporting said element in adjustable relation over said ground plane;

said element support adjustably reconfiguring said antenna by repositioning at least a portion of said active element relative to said ground plane; and a variable gain pattern corresponding to said variable active element configuration relative to said ground plane;

said element support having a lower end mounted on said ground plane and an upper end mounting said element;

said element support being vertically adjustable and adapted for raising and lowering said element relative to said ground plane;

said active element comprising a crossed-dipole radiating arm element assembly including a central hub mounted on the central support upper end and multiple arms extending radially outwardly from said central hub;

a support height adjuster comprising a servo drive motor mounted on said base; and said height adjuster adjusting the height of said support among said antenna configurations.

2. The antenna according to claim 1, which includes:

said element support comprising a printed circuit board (PCB) with a lower end mounted on said ground plane and an upper end mounting said element;

a phasing and matching network mounted on said support PCB and connected to said radiating element;

said base including a base PCB mounting said ground plane; and a low noise amplifier (LNA) mounted on said base PCB and connected to said phasing and matching network.

3. The antenna according to claim 2, which includes:

a balun connected to said phasing and matching network;

a first bandpass filter connected to said balun;

said LNA connected to said first bandpass filter;

a second bandpass filter connected to said LNA and to a line out; and a bias network providing feedback from said line out to said LNA.

4. The antenna according to claim 1, which includes:

said support PCB being manufactured to provide either a low-profile antenna by mounting said support on said base at a first location or a high-profile antenna by mounting said support on said base at a second location;

said low-profile antenna providing relatively narrow beamwidth;

said high-profile antenna providing relatively wide beamwidth;

said high-profile antenna providing superior below-horizon signal acquisition; and said antenna low profile configuration corresponding to less multipath susceptibility.

5. The antenna according to claim 4, which includes:

said antenna operating across the super bands of GNSS frequencies comprising 1525-1613 MHz (L1) and 1165-1253 MHz (L2).

6. The antenna according to claim 5 wherein:

said arms are flexible and droop downwardly towards said ground plane; and said downward droop of said radiating arms is adjustable for adjusting a beamwidth of said antenna.

7. The antenna according to claim 1, which includes:

said element support having a lower end mounted on said ground plane and an upper end mounting said element;

said element including a first opposed pair of said arms each connected to said support upper end by an inductive conductor trace extending torn the respective arm to said phasing and matching network;

said phasing and matching network having a pair of capacitors; and said element including a second opposed pair of said arms each connected to said support upper end and to a respective said capacitor.

8. The antenna according to claim 5, which includes:

each said arm having an inner end connected to said hub and an outer end;

each said arm diverging outwardly; and each said arm outer end having either a notched or a squared configuration.

9. The antenna according to claim 1, which includes: said support height adjuster including a threaded rod driven by said drive motor and connected to said support.

10. The antenna according to claim 1, which includes:

said arms having helical configurations with inner ends connected to said hub and outer ends located over said ground plane; and said central hub and said arm inner ends being movable between raised and lowered positions relative to said ground plane whereby said antenna gain pattern is variable for optimizing said antenna for multiple applications.

11. The antenna according to claim 1, which includes:

said ground plane including a central element and multiple conductive extension elements;

a plurality of PiN diodes each connecting said central element and a respective extension element; and each said PiN being switchable by a predetermined RF frequency between open and closed states respectively separating and connecting said central element and a respective extension element.

12. A GNSS antenna, which includes:

a base including a conductor ground plane;

an active element comprising a crossed-dipole radiating arm element assembly including a central hub mounted on the central support upper end and multiple arms extending radially outwardly from said central hub;

said arms being flexible and drooping downwardly towards said ground plane;

said downward droop of said radiating arms being adjustable for adjusting a beamwidth of said antenna;

an adjustable element support comprising a printed circuit board (PCB) with a lower end mounted on said ground plane and an upper end connected to said central hub and supporting said element assembly in adjustable relation over said ground plane, said element support being vertically adjustable and adapted for raising and lowering said element relative to said ground plane;

a variable gain pattern corresponding to said variable active element configuration relative to said ground plane;

a phasing and matching network mounted on said support PCB and connected to said active element;

a balun connected to said phasing and matching network;

said base including a base PCB mounting said ground plane;

a low noise amplifier (LNA) mounted on said base PCB;

a first bandpass filter connected to said balun;

said LNA connected to said first bandpass filter;

a second bandpass filter connected to said LNA and to a line out;

a bias network providing feedback from said line out to said LNA;

said support PCB being manufactured to provide either a low-profile antenna by mounting said support on said base at a first location or a high-profile antenna by mounting said support on said base at a second location;

said low-profile antenna providing relatively narrow beamwidth;

said high-profile antenna providing relatively wide beamwidth;

said high-profile antenna providing superior below-horizon signal acquisition;

said antenna low profile configuration corresponding to less multipath susceptibility;

said antenna operating across the super bands of GNSS frequencies comprising 1525-1613 MHz (L1) and 1165-1253 MHz (L2);

said element support having a lower end mounted on said ground, plane and an upper end mounting said element;

said element including a first opposed pair of said arms each connected to said support upper end by an inductive conductor trace extending from the respective atm to said phasing and matching network;

said phasing and matching network having a pair of capacitors;

said element including a second opposed pair of said arms each connected to said support upper end and to a respective capacitor;

each said arm having an inner end connected to said hub and an outer end;

each said arm diverging outwardly; and each said arm outer end having either a notched or a squared configuration.

13. A method of receiving and amplifying GNSS signals, which comprises the steps of:

providing a base including a conductor ground plane;

providing an active element;

adjustably supporting said active element on said base;

reconfiguring said antenna by repositioning at least a portion of said active element relative to said ground plane;

varying a gain pattern of said antenna corresponding to said variable active element configuration relative to said ground plane;

providing a support with a lower end connected to said base and an upper end connected to said active element;

extending and retracting said support;

vertically raising and lowering said active element with said support providing a support with a lower end connected to said base and an upper end connected to said active element;

providing said active element with a crossed-dipole radiating arm element assembly configuration including a central hub mounted on the support upper end and multiple arms extending radially outwardly from said central hub;

constructing said arms from a flexible material and drooping said arms downwardly towards said ground plane; and adjusting a beamwidth of said antenna by adjusting the downward droop of said radiating arms.

14. The method according to claim 13, which includes the additional steps of:

forming said element support from a support printed circuit board (PCB) with a lower end mounted on said ground plane and an upper end mounting said element;

providing a phasing and matching network mounted on said support PCB and connected to said active element;

providing said base with a base PCB mounting said ground plane;

providing a low noise amplifier (LNA) mounted on said base PCB and connected to said phasing and matching network;

providing a balun connected to said phasing and matching network;

providing a first bandpass filter connected to said balun;

providing said LNA connected to said first bandpass filter;

providing a second bandpass filter connected to said LNA and to a line out;

providing a bias network providing feedback from said line out to said LNA; and mounting said support on said base at a first location for a low-profile antenna with a relatively narrow beamwidth and less multipath susceptibility or mounting said support on said base at a second location for a high-profile antenna with a relatively wide beamwidth and superior below-horizon signal acquisition; and operating said antenna across the super bands of GNSS frequencies comprising 1525-1613 MHz (L1) and 11.65-1253 MHz (L2).

15. A method of manufacturing a GNSS antenna with a selectable gain pattern, which method comprises the steps of:

providing a base including a conductor ground plane;

providing an active element, said active element comprising a crossed-dipole radiating arm element assembly including a central hub mounted on the central support upper end and multiple arms extending radially outwardly from said central hub;

adjustably supporting said active element on said base;

reconfiguring said antenna by repositioning at least a portion of said active element relative to said ground plane;

varying a gain pattern of said antenna corresponding to said variable active element configuration relative to said ground plane;

providing a support with a lower end connected to said base and an upper end connected to said active element;

providing a support height adjuster comprising a servo drive motor mounted on said base; and said height adjuster adjusting the height of said support among said antenna configurations.

16. The method according to claim 15, which includes the additional steps of providing the support with a support printed circuit board (PCB) with multiple attachment points; and forming said antenna with multiple heights of said element by attaching said support PCB to said ground plane and said element at respective attachment points.

17. The method according to claim 15, which includes the additional steps of providing a phasing and matching network, a balun connected to the phasing and matching network and a low noise amplifier (LNA) connected to the balun, which are common to the multiple configurations of the antenna.

18. The method according to claim 15, which includes the additional steps of:

producing antennas with variable gain patterns, beamwidths, multipath susceptibility and below-horizon signal acquisition characteristics using common ground planes, active elements, element supports and signal processing components.

* * * * *